US008934640B2

(12) United States Patent
Goodwin

(10) Patent No.: US 8,934,640 B2
(45) Date of Patent: Jan. 13, 2015

(54) MICROPHONE ARRAY PROCESSOR BASED ON SPATIAL ANALYSIS

(75) Inventor: Michael M. Goodwin, Scotts Valley, CA (US)

(73) Assignee: Creative Technology Ltd, Singapore (SG)

( * ) Notice: Subject to any disclaimer, the term of this patent is extended or adjusted under 35 U.S.C. 154(b) by 1116 days.

(21) Appl. No.: 12/197,145

(22) Filed: Aug. 22, 2008

(65) Prior Publication Data

US 2009/0103749 A1 Apr. 23, 2009

Related U.S. Application Data

(60) Provisional application No. 60/981,458, filed on Oct. 19, 2007.

(51) Int. Cl.
*H04R 3/00* (2006.01)

(52) U.S. Cl.
CPC ..... *H04R 3/005* (2013.01); *H04R 2430/20* (2013.01); *H04S 2400/11* (2013.01)
USPC ..... 381/92

(58) Field of Classification Search
CPC . H04R 2430/20; H04R 3/005; H04S 2400/11
USPC ..... 381/92; 704/200, 206, 226–228
See application file for complete search history.

(56) References Cited

U.S. PATENT DOCUMENTS

| | | | | |
|---|---|---|---|---|
| 7,206,421 | B1 * | 4/2007 | Taenzer | 381/119 |
| 7,720,232 | B2 * | 5/2010 | Oxford | 381/66 |
| 2004/0013038 | A1 * | 1/2004 | Kajala et al. | 367/119 |

FOREIGN PATENT DOCUMENTS

| | | | |
|---|---|---|---|
| JP | 2004-048741 | A | 2/2004 |
| JP | 2007-147732 | A | 6/2007 |

OTHER PUBLICATIONS

Sawada et al. ("Blind Extraction of Dominant Target Sources Using ICA and Time-Frequency Masking" IEEE Transactions on Audio, Speech, and Language Processing, vol. 14, No. 6, Nov. 2006).*
Hiroshi, Sawada et al., "Blind Extraction of Dominant Target Sources Using ICA and Time Frequency Masking," IEEE Transactions on Audio, Speech, and Language Processing, vol. 14 No. 6, Nov. 2006.

* cited by examiner

*Primary Examiner* — Sue Tang
(74) *Attorney, Agent, or Firm* — Russell Swerdon; Desmund Gean

(57) ABSTRACT

An array processing system improves the spatial selectivity by forming multiple steered beams and carrying out a spatial analysis of the acoustic scene. The analysis derives a time-frequency mask that, when applied to a reference look-direction beam (or other reference signal), enhances target sources and substantially improves rejection of interferers that are outside of the specified region.

14 Claims, 1 Drawing Sheet

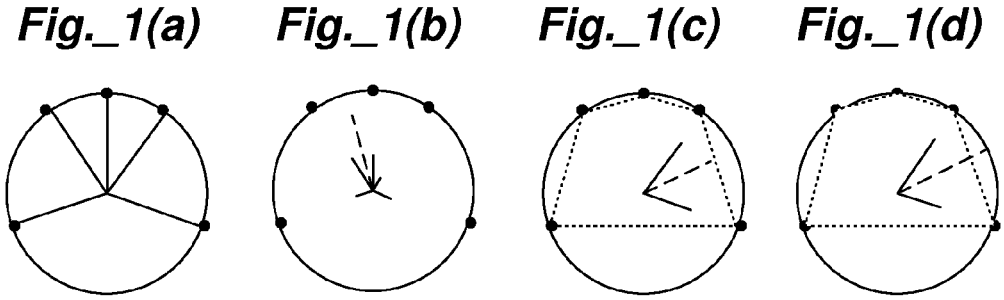
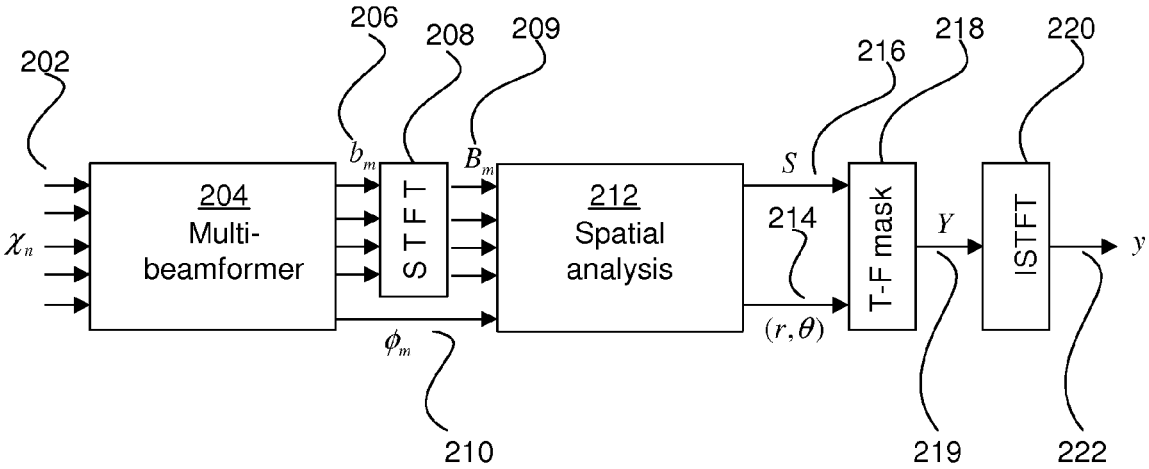
FIG. 2

MICROPHONE ARRAY PROCESSOR BASED ON SPATIAL ANALYSIS

CROSS-REFERENCES TO RELATED APPLICATIONS

This application is related to and incorporates by reference U.S. patent application Ser. No. 11/750,300, filed May 17, 2007, titled "Spatial Audio Coding Based on Universal Spatial Cues", which incorporates by reference the disclosure of U.S. Provisional Application No. 60/747,532, filed May 17, 2006, the disclosure of which is further incorporated by reference in its entirety herein. Further, this application claims priority to and the benefit of the disclosure of U.S. Provisional Patent Application Ser. No. 60/981,458, filed on Oct. 19, 2007, and entitled "Enhanced Microphone Array Beamformer Based on Spatial Analysis" (CLIP231PRV), the entire specification of which is incorporated herein by reference in its entirety.

BACKGROUND OF THE INVENTION

1. Field of the Invention

The present invention relates to microphone arrays. More particularly, the present invention relates to processing methods applied to such arrays.

2. Description of the Related Art

Distant-talking hands-free communication is desirable for teleconferencing, IP telephony, automotive applications, etc. Unfortunately, the communication in these applications is often hindered by reverberation and interference from unwanted sound sources. Microphone arrays have been previously used to improve speech reception in adverse environments, but small arrays based on linear processing such as delay-sum beamforming allow for only limited improvement due to low directionality and high-level sidelobes.

What is desired is an improved beamforming system.

SUMMARY OF THE INVENTION

The present invention provides a beamforming and processing system that improves the spatial selectivity of a microphone array by forming multiple steered beams and carrying out a spatial analysis of the acoustic scene. The analysis derives a time-frequency mask that, when applied to a reference look-direction beam (or other reference signal), enhances target sources and substantially improves rejection of interferers that are outside of a specified target region.

In one embodiment, a method of enhancing an audio signal is provided. An input signal is received at a microphone array having a plurality of transducers. A plurality of audio signals is then generated from the microphone array. The plurality is processed in a multi-beamformer to form multiple steered beams for sampling the audio scene as well as a reference signal, for instance a reference beam in the direction of the target source (where this reference beam could be one of the aforementioned multiple steered beams). A spatial direction vector is assigned to each of the multiple steered beams. The spatial direction vectors are associated with the corresponding beam signals generated by the multi-beamformer. A spatial analysis based on the spatial direction vectors and the beam signals is carried out. The results of the spatial analysis are applied to improve the spatial selectivity of the reference look-direction beam (or other reference signal).

In one embodiment, the multiple steered beams are generated by combining input microphone signals with at least one of progressive delays and elemental filters applied to transducers in the array.

In other embodiments, the reference signal is determined as a summation of the plurality of beam signals; a single microphone signal from the microphone array; a look-direction beam, or a tracking beam tracking a selected talker.

In yet another embodiment, an enhancement operation comprises determining a time-frequency mask and applying it to the reference signal In a further embodiment, the time-frequency mask is further adapted to reject interference signals arriving from outside a predefined target region.

In another embodiment still, a method of enhancing the spatial selectivity of an array configured for receiving a signal from an environment includes receiving a signal at a plurality of elements and generating a plurality of steered beams for sampling the acoustic environment. A reference signal is identified and a direction of arrival is estimated for each time and frequency. In some embodiments, the estimated direction of arrival includes an amplitude parameter which indicates a degree of directionality of the sound environment at that time and frequency. [MGI]The estimates are used as a basis for accepting, attenuating, or rejecting components of the reference signal to create an output signal.

These and other features and advantages of the present invention are described below with reference to the drawings.

BRIEF DESCRIPTION OF THE DRAWINGS

FIG. 1 is a diagram illustrating direction vectors for a standard 5-channel format.

FIG. 2 is a block diagram illustrating an enhanced beamformer in accordance with one embodiment of the present invention.

DETAILED DESCRIPTION OF PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

Embodiments of the invention provide improved beamforming by forming multiple steered beams and carrying out a spatial analysis of the acoustic scene. The analysis derives a time-frequency mask that, when applied to a reference signal such as a look-direction beam, enhances target sources and substantially improves rejection of interferers that are outside of the identified target region. A look-direction beam is formed by combining the respective microphone array signals such that the microphone array is maximally receptive in a certain direction referred to as a "look" direction. Though a look-direction beam is spatially selective in that sources arriving from directions other than the look direction are generally attenuated with respect to look-direction sources, the relative attenuation is insufficient in adverse environments. For such environments, additional processing such as that disclosed in the current invention is beneficial.

The beamforming algorithm described in the various embodiments enables the effective use of small arrays for receiving speech (or other target sources) in an environment that may be compromised by reverberation and the presence of unwanted sources. In a preferred embodiment, the algorithm is scalable to an arbitrary number of microphones in the array, and is applicable to arbitrary array geometries.

In accordance with one embodiment, the array is configured to form receiving beams in multiple directions spanning the acoustic environment. A known, identified, or tracked direction is determined for the desired source.

The present invention in various embodiments is concerned fundamentally with microphone array methods, which are advantageous with respect to single microphone approaches in that they provide a spatial filtering mechanism that can be flexibly designed based on a set of a priori conditions and readily adapted as the acoustic conditions change, e.g. by automatically tracking a moving talker or steering nulls to reject time-varying interferers. While such adaptivity is useful for responding to changing and/or challenging acoustic environments, there is nevertheless an inherent limitation in the performance of simple linear beamformers in that unwanted sources are still admitted due to limited directionality and sidelobe suppression; for small arrays, such as would be suitable in consumer applications, low directionality and high-level sidelobes are indeed significant problems. The present invention in various embodiments provides a beamforming and post-processing scheme that employs spatial analysis based on multiple steered beams; the analysis derives a time-frequency mask that improves rejection of interfering sounds that are spatially distinct from the desired source.

For background purposes, the methods described apply spatial analysis methods previously applied to distinct channel signals. For example, the spatial analysis methods have previously been applied to multichannel systems where the inputs include distinct channel signals and their spatial positions (determined by the format angles). In embodiments of the present invention, a multi-beamformer is used to decompose the input signal from the transducers in the array into a plurality of individual beam signals and to assign a spatial context (such as a direction vector) to each of the received beam signals.

The spatial analysis-synthesis scheme described in the following was developed for spatial audio coding (SAC) and enhancement. The analysis derives a parameterization of the perceived spatial location of sound events. In the synthesis, these spatial cues are used to render a faithful reproduction of the input scene; or, alternatively, the cues can be modified to produce a spatially altered rendition. The following discussion focuses on important concepts for applying the spatial analysis-synthesis to the beamforming system of the present invention.

Spatial Cues

In a basic theory of auditory localization, the perceived aggregate direction when the same signal arrives at a listener from M different directions (with different weights αm) is given by $$\vec{g} = \sum_{m=1}^{M} \beta_m \vec{p}_m \tag{1}$$

where the $\vec{p}_m$ are unit vectors indicating the M signal directions, hereafter referred to as format vectors; the normalized weights $\beta_m$ for the various directions are given by the signal weights $\alpha_m$ according to $$\beta_m = \frac{|\alpha_m|^2}{\sum_{i=1}^{M} |\alpha_i|^2} \tag{2}$$

This so-called Gerzon vector is readily applicable to localization of multichannel audio signals, for instance in a standard five channel audio format, for example where the format vectors $\vec{p}_m$ correspond to the angles {−30°, 30°, 0°, −110°, 110°}.

FIG. 1 shows the application of various direction vectors in a listening environment. FIG. 1(*a*) depicts the vectors for a standard 5-channel audio format. In FIG. 1(*b*), the Gerzon vector (dashed) as specified in Eqs. (1) and (2) is shown for a 5-channel signal (solid); in FIG. 1(*c*), the Gerzon vector for 2 active channels is shown; and in FIG. 1(*d*), the corresponding enhanced direction vector is shown. The plots of FIGS. 1(*c*) and 1(*d*) also show the polygonal encoding locus of the Gerzon vector. Gerzon direction vectors, enhanced direction vectors, and associated methods for spatial analysis are described in further detail in Ser. No. 11/750,300, titled "Spatial Audio Coding Based on Universal Spatial Cues", incorporated by reference herein.

In a listening-circle scenario with a central listener and with the positions of sound events parameterized by polar coordinates (r,θ), where the angle θ is the sound direction and the radius r is its location in the circle; r=1 corresponds to a discrete point source, r=0 corresponds to a non-directional source, and intermediate r values correspond to positions within the circle such as in fly-over or fly-through sound events. Given an ensemble of signals (a multichannel audio signal) and the respective format vectors (channel angles), the Gerzon vector of Eq. (1) provides a reliable estimate of the aggregate angle θ of the perceived sound event in this listening-circle scenario. However, the Gerzon vector has a shortcoming in that it underestimates r because its magnitude is limited by the inscribed polygon defined by the format vectors $\vec{p}_m$. This encoding locus is depicted in FIG. 1(*c*) with an example of the magnitude underestimation for a signal with two active adjacent channels. For such a pairwise-panned point source, the desired result (r=1) is depicted in FIG. 1(*d*). The intrinsic Gerzon vector magnitude underestimation is resolved in the spatial analysis approach described in application Ser. No. 11/750,300, filed May 17, 2007, titled "Spatial Audio Coding Based on Universal Spatial Cues", incorporated by reference herein, essentially by a compensatory resealing. In this method, the vector $\vec{p}g$ is decomposed into pairwise and non-directional (or null) components, and the enhanced direction vector is formulated as $$\vec{d} = r\frac{\vec{g}}{\|\vec{g}\|} \tag{3}$$

where the radius r is based on the pairwise-null decomposition.

Specifically, $$r = \|P_{ij}^{-1}\vec{g}\|_1 \tag{4}$$

where the columns of the matrix $P_{ij}$ are the two format vectors $\vec{p}_i$ and $\vec{p}_j$ that bracket $\vec{g}$, i.e. those whose angles are closest (on either side) to the angle cue θ given by $\vec{g}$. The radius r is then the sum of the coefficients of the expansion of $\vec{g}$ in the basis defined by these adjacent format vectors $\vec{p}_i$ and $\vec{p}_j$.

Key ideas relevant to various beamforming system embodiments of the present invention are: (1) the direction vector $\vec{d}$ (or $\vec{g}$) gives a robust aggregate signal direction θ; and, (2) the radius r essentially captures the extent that a received signal originated from multiple directions. Those of skill in the art will understand that in the two-dimensional case the direction vector $\vec{d}$ (or $\vec{g}$) can be equivalently expressed using coordinates (r,θ).

Embodiments of the present invention adapt this scheme to a beamforming scenario by forming multiple steered beams that essentially sample the acoustic scene at various directions given by the steering angles $\phi_m$. In one embodiment, the multi-beamforming and steering is carried out by linearly combining the input microphone signals $x_n[t]$ with progressive delays nmτ, and elemental filters $a_n[t]$:

$$b_m[t] = \sum_n a_n[t] * x_n[t - nm\tau_s]. \tag{5}$$

In other embodiments, alternate approaches are used to form multiple beams in different directions. In a preferred embodiment, the $a_n[t]$ are designed to achieve frequency invariance in the beam patterns. In another embodiment, simple uniform weighting $a_n[t]=\delta[t]$ can be used so as to minimize the processing cost. The unit delays $\tau_s$, which are established by the processing sample rate $F_s$, result in a discretization of the beamformer steering angles. For a linear array geometry, the steering angles are given by:

$$\begin{aligned}\phi_m &= \arcsin\left(\frac{m\tau_s}{\tau_0}\right) \\ &= \arcsin\left(\frac{m}{\tau_0 F_s}\right)\end{aligned} \tag{6}$$

where $\tau_0$ is the inter-element travel time for the most closely spaced elements in the array. In a preferred embodiment, a linear array geometry is used, but the approach could be applied to other configurations as well.

A block diagram of an enhanced beamforming system in accordance with one embodiment of the present invention is shown in FIG.2. Initially, the incoming microphone signal $x_n$ (202) comprising the individual transducer signals arriving from the microphone array is received; these incoming microphone signals are time-domain signals, but the time index has been omitted from the notation in the diagram. As noted earlier, the incoming signal 202 may include the desired signal as well as additional signals such as interference from unwanted sources and reverberation, all as picked up and transferred by the individual transducers (microphones). In block 204, the received signals are processed so as to generate beam signals corresponding to multiple steered beams. As depicted, the M beam signals $b_m[t]$ (206) are converted via an STFT (short-time Fourier transform) 208 to time-frequency representations $B_m[k,l]$ (209); these beam signals 209 are then provided to the spatial analysis module 212 along with their spatial context (steering angles $\phi_m$(210)). In an alternative embodiment, the multi-beamforming and the spatial post-processing are integrated by implementing the multi-beamformer in the frequency domain as will be understood by those of skill in the relevant art.

In the spatial analysis module 212, the (r,θ) cues (214) are derived from the beam signals 209 and the beam steering directions 210. A reference signal S[k,l] (216), preferably corresponding to a beam steered in the look direction, e.g., the $B_m[k,l]$ (209) whose steering angle is closest to the desired look direction $\theta_0$. In different embodiments, however, the reference signal may be represented by a summation of all of the beam signals generated in the multi-beamformer, a single-microphone signal, or a signal generated by an allpass beam (a beam with uniform spatial receptivity). In order to generate the output signal 219 from the reference signal 216, a multiplicative time-frequency mask based on the spatial criteria (cues) 214 is applied in block 218. Generally, the spatial analysis 212 is used to aggregate multiple received signals to yield a dominant direction. The spatial selectivity of the reference signal, e.g. the reference look-direction beam, is then enhanced by the filtering operation realized by applying the time-frequency mask in block 218, said filtering being based on the directional cues 214. The synthesis signal 219 is then processed in an inverse short term Fourier transform module 220 to generate the enhanced time-domain output signal 222.

In embodiments of the present invention the generation of the synthesis signals from the reference signal using the spatial cues can be interpreted as an application of a time-frequency mask that extracts components based on spatial criteria. In one embodiment, a Spatial Audio Coding (SAC) application, a specific construction of the mask (i.e. panning weights) helps achieve the goal of recreating the input audio scene at the decoder. In the beamforming embodiment, however, the mask construction can readily be generalized as follows:

$$Y[k,l]=H(r[k,l],\theta[k,l])S[k,l] \tag{7}$$

where H( ) is a time-frequency mask that is a function of the (r[k,l],θ[k,l]), namely the time and frequency-dependent spatial information determined by the spatial analysis. In one embodiment, H( ) is constructed by establishing a "synthesis format" consisting of an output channel angle $\theta_0$ in the desired look direction, nearby adjacent channels on either side of the look direction (e.g. at $\theta_0$±5°), and widely spaced channels (e.g. at $\theta_0$±90°). Then, in a further aspect of this embodiment, H( ) would be established as the panning mask for channel 0, and only components for which θ[k,l] lies between the adjacent channels (i.e. those at $\theta_0$±5°) will be panned into the channel 0 output signal; in a full synthesis embodiment, components in other directions would be panned between the other channels. Furthermore, the mask can be adjusted so as to only include the pairwise component, namely r[k,l] $\vec{\rho}$ [k,l]. Since r[k,l] will be large (close to one) for values of k and l where there are no significant interferers at directions other than θ[k,l], and smaller when such interferers are present, a mask proportional to r[k,l] will suppress the time-frequency regions of the reference signal that are corrupted by interferers (that are spatially distinct from the look direction).

While the mask described above has proven effective in experiments, it involves some unnecessary complexity in the pairwise-panning construction used to pan the reference signal into the output channels. In another embodiment, the mask is constructed directly as a function of the spatial cues, e.g.

$$H(r,\theta)=\begin{cases} r\left(1-\frac{|\theta-\theta_0|}{\Delta}\right) & \text{for } |\theta-\theta_0|\le\Delta \\ 0 & \text{for } |\theta-\theta_0|\le\Delta \end{cases} \tag{8}$$

where $\theta_0$ is the desired look direction and the angle width Δ defines a transition region around $\theta_0$ corresponding to a triangular spatial window.

Accordingly, the present invention embodiments provide several improvements over conventional technology. The rejection of unwanted sources is substantially improved over conventional beamformers. Compared to other enhancement methods, the algorithm is more efficient than "source separation" beamformers and more effective than enhancement "post-filters" based on statistical estimation of the source and interferer characteristics. The present invention can be interpreted as an improved post-filtering method where the post-filter is derived based on spatial analysis. Furthermore, the algorithm is easily applicable to broadband cases, unlike some enhanced beamforming methods.

The scope of the invention embodiments may be extended to include any types of microphone arrays for example ranging from two-microphone systems to extended multi-microphone systems. In alternative embodiments, the technology could also be applied in multi-microphone hearing aids.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method of enhancing an audio signal comprising:

receiving an input signal at a microphone array having a plurality of transducers;

generating from the microphone array a plurality of audio signals;

processing the plurality of audio signals to form a reference signal;

processing the plurality of audio signals to form multiple steered beams;

deriving a plurality of directional cues from the multiple steered beams and multiple beam steering directions; and applying spatial analysis to the multiple steered beams to characterize the audio scene, wherein the spatial analysis comprises estimating a dominant direction for each time and frequency and using that estimate in determining the degree of the reference signal component at that time and frequency is included in an output signal, wherein the plurality of directional cues are used to generate a time-frequency mask to enhance the output signal.

2. The method as recited in claim 1 wherein the spatial analysis comprises assigning a spatial direction vector to each of the multiple steered beams and associating the vector with the generated beam signals from a multi-beamformer.

3. The method as recited in claim 1 further comprising using a characterization to construct an enhancement operation that, when applied to the reference signal.

4. The method as recited in claim 3 wherein the enhancement operation comprises deriving a multiplicative time-frequency mask and applying it to a reference signal.

5. The method as recited in claim 4 wherein the reference signal is a summation of the plurality of beam signals.

6. The method as recited in claim 4 wherein the reference signal is a single microphone signal.

7. The method as recited in claim 4 wherein the reference signal corresponds to a beam steered in a predetermined look direction.

8. The method as recited in claim 4 wherein the reference signal is a tracking beam tracking a selected talker.

9. The method as recited in claim 4 wherein the time-frequency mask is derived using (r,θ) spatial information, where r is a parameter measuring the extent that a received signal originates from multiple directions and θ is the angle of a direction vector corresponding to the dominant sound direction.

10. The method as recited in claim 1 wherein the multiple steered beams are generated by combining the input microphone signals with at least one of progressive delays and elemental filters applied to the transducers in the array.

11. A method of enhancing an audio signal comprising:

forming multiple steered beams; and performing a spatial analysis of the audio scene based on the multiple steered beams;

deriving a plurality of directional cues from the multiple steered beams and multiple beam steering directions; and using the results of the spatial analysis and the plurality of directional cues to derive a multiplicative time-frequency mask that is applied to a reference signal to enhance target sources, the spatial analysis comprising dominant direction estimates used in determining the degree of the reference signal component at particular times and frequencies.

12. The method as recited in claim 11 wherein the reference signal is a look-direction beam.

13. The method as recited in claim 11 wherein the time-frequency mask is further adapted to reject interference signals arriving from outside a predefined target region.

14. A method of enhancing the spatial selectivity of an array configured for receiving a signal from an environment, the method comprising:

receiving a signal at a plurality of elements;

generating a plurality of steered beams for sampling the acoustic environment;

identifying a reference signal;

deriving a plurality of directional cues from the plurality of steered beams and multiple beam steering directions; and estimating for each time and frequency a direction of arrival; and using the estimates as a basis for accepting, attenuating, or rejecting components of the reference signal to create an output signal, wherein the plurality of directional cues are used to generate a multiplicative time-frequency mask to enhance the output signal.

* * * * *